US010597199B1

(12) United States Patent
Manning

(10) Patent No.: US 10,597,199 B1
(45) Date of Patent: Mar. 24, 2020

(54) CLOSURE AND AN ASSEMBLY OF THE CLOSURE WITH A CONTAINER

(71) Applicant: Christopher Joseph Manning, Columbia, MD (US)

(72) Inventor: Christopher Joseph Manning, Columbia, MD (US)

( * ) Notice: Subject to any disclaimer, the term of this patent is extended or adjusted under 35 U.S.C. 154(b) by 212 days.

(21) Appl. No.: 15/731,565

(22) Filed: Jun. 29, 2017

Related U.S. Application Data

(60) Provisional application No. 62/493,367, filed on Jul. 1, 2016.

(51) Int. Cl.

| | |
|---|---|
| ***B65D 39/00*** | (2006.01) |
| ***B65D 41/04*** | (2006.01) |
| ***B65D 1/02*** | (2006.01) |
| ***B65D 51/24*** | (2006.01) |
| ***B65D 51/16*** | (2006.01) |
| *B65D 53/00* | (2006.01) |

(52) U.S. Cl.
CPC ..... *B65D 41/0407* (2013.01); *B65D 1/023* (2013.01); *B65D 41/045* (2013.01); *B65D 41/0442* (2013.01); *B65D 41/0471* (2013.01); *B65D 51/1644* (2013.01); *B65D 51/244* (2013.01)

(58) Field of Classification Search
CPC ..... B65D 41/0407; B65D 1/023; B65D 41/0442; B65D 41/045; B65D 41/0471; B65D 51/1644; B65D 51/244
USPC ..... 215/365, 355, 364, 323; 220/364, 365
See application file for complete search history.

(56) References Cited

U.S. PATENT DOCUMENTS 3,213,674 A * 10/1965 Salcido ..... G01M 3/2876 138/90
3,240,379 A * 3/1966 Bremer ..... F16L 41/08 220/359.1
3,434,743 A * 3/1969 Boeker ..... E21B 33/04 285/321
4,044,798 A * 8/1977 Feldstein ..... F16L 55/1116 138/89
5,249,899 A * 10/1993 Wilson ..... B25B 13/06 411/258
5,360,302 A * 11/1994 MacMartin ..... F16B 39/021 411/23

(Continued)

*Primary Examiner* — J. Gregory Pickett
*Assistant Examiner* — Niki M Eloshway
(74) *Attorney, Agent, or Firm* — Ascentage Patent Law, LLC; Travis Lee Johnson

(57) ABSTRACT

An assembly of a closure with a container, for sealing of the container, comprises the container having an inner container surface defining a cavity opening to ambient through an opening, the closure comprising an upper portion and a lower portion, the lower portion having a lower lateral surface, the lower portion being adapted to be inserted into the opening of the container and two grooves provided on the lower lateral surface and adapted to receive two respective sealing members, the two grooves being separated by a predetermined distance, the two sealing members provided in the two respective grooves, the two sealing members being adapted to provide sealing between the lower lateral surface and the inner container surface, wherein the lower lateral surface, the inner container surface and the two auxiliary sealing members together define an annular space and a barrier sealant in the annular space.

17 Claims, 8 Drawing Sheets

(56) References Cited

U.S. PATENT DOCUMENTS

| | | | | |
|---|---|---|---|---|
| 6,896,462 | B2 * | 5/2005 | Stevenson | F16B 13/002 411/1 |
| 8,439,220 | B2 * | 5/2013 | Norman | F01D 11/00 220/228 |
| 8,974,505 | B2 * | 3/2015 | Sawa | A61B 17/7098 606/304 |
| 10,168,111 | B2 * | 1/2019 | Al-Otaibi | F16L 55/11 |
| 2004/0033120 | A1 * | 2/2004 | Ducker, III | F16B 33/004 411/82.1 |
| 2005/0173371 | A1 * | 8/2005 | Zeni | B65D 39/0011 215/364 |

* cited by examiner

CLOSURE AND AN ASSEMBLY OF THE CLOSURE WITH A CONTAINER

FIELD OF THE INVENTION

The present invention generally relates to sealants and sealing materials and in particular to devices and methods for use in sealing containers, chambers and spaces so as to provide effective barriers against ingress of environmental components and egress of contents, particularly volatile components, to and from materials packaged, shipped, stored, processed or otherwise present in the containers.

BACKGROUND ART

From long before the dawn of civilization to the present day, hominids have faced a choice of how much of their food to eat and how much to save for future uses, particularly planting, future consumption and animal feed. It is important that certain and perhaps different qualities be preserved over the storage periods for both food and seed. More recently hominids have introduced commerce, and into commerce various other commodities, many of which require special storage conditions. Maintaining optimal storage conditions usually implies sealing to prevent exchange with the environment. Throughout history and prehistory hominids have stored commodities, including agricultural products, in a variety of containers. Perhaps the best success with storage has been realized in glass, ceramic and metal containers. It long has been observed that many commodities are better preserved in the absence of oxygen, moisture or both. This would be the case if only because insects and rodents are unable to eat in the absence of air or oxygen, but also because preventing or minimizing exposure to oxygen and moisture retards spoilage by oxidation, microbes and hydrolysis.

Below a certain water activity level, bacteria and molds are incapable of activity. Many bacteria and fungi also are unable to function in the absence of oxygen. Thus, it would be beneficial if closing devices for containers could be manufactured to seal in ways that provide strong barriers to ingress of oxygen, moisture and other environmental substances. In some cases, stored commodities are susceptible to losses by evaporation, including loss of volatiles, where strong barriers can provide additional protection of product quality. For example, by preventing loss of flavors or essential oils. By strong is meant low permeability.

In recent centuries, Herculean efforts have been expended to achieve better sealing of containers in science, engineering, art and commerce. Many of these efforts are represented in the patent, technical and scientific literature. The best prior art approaches to achieve high quality sealing include metal-to-metal contact with pressure or fusion and metal-to-glass contact with pressure, chemical bonding, fusion or some combination thereof. Continuous contact and considerable pressure generally are required to seal metal to glass and metal to metal, necessitating precision machined hardware, high torque values, multiple fasteners or other relatively expensive measures. These approaches generally have not been feasible for containers employed in routine commerce of commodities, both because of the expense of precision high-strength hardware and close-tolerance manufacture, and the fact that these approaches are not suited to high-speed processing.

Thus, the standard practice in commerce has been to manufacture glass jars with metal or plastic closures, where the seal is made with a thin gasket of inexpensive and often toxic polymer. In many cases, the plasticized polymer is permanently bonded to a metal closure using a plastisol process. Many plastisol seals utilize endocrine disruptors or other toxic compounds as plasticizers, which, all other things being equal, are undesirable for use in food containers, except in cases where profits are preferred over customer safety. In the case of metal cans, the seams often are sealed with plastisol during rolling and crimping, which provides an effective barrier against microbial contamination and dust, but not against ingress of oxygen and moisture, nor egress of volatiles. Clay containers are quite rare in modern commerce, but were important in ancient times. Were it possible to seal them well, they might play a more important role in future commerce.

Unfortunately, the polymers used to seal almost all containers of commerce are invariably permeable to gases and vapors, the inexpensive polymers moreso than others. The plasticizers in plastisols, particularly phthalates and oxygenated oils, are susceptible to migration into products held in the containers. In fact, there are very few, if any, polymers that are able to effectively block migration of gases and vapors. There is a wide range of barrier effectiveness across the many families of polymers.

In light of the discussion above, there is required a closure and an assembly of the closure with a container, that does not suffer from above mentioned deficiencies.

Throughout this specification, unless the context requires otherwise, the words "comprise", "comprises" and "comprising" will be understood to imply the inclusion of a stated step or element or group of steps or elements but not the exclusion of any other step or element or group of steps or elements.

Any one of the terms: "including" or "which includes" or "that includes" as used herein is also an open term that also means including at least the elements/features that follow the term, but not excluding others.

Any discussion of the background art throughout the specification should in no way be considered as an admission that such background art is prior art nor that such background art is widely known or forms part of the common general knowledge in the field in the U.S. or anywhere else.

SUMMARY OF THE INVENTION

According to a first aspect of the present invention, there is provided an assembly of a closure with a container, for sealing of the container, the assembly comprising the container having an inner container surface defining a cavity opening to ambient through an opening, the inner surface continuing through the opening to be contiguous with the outer surface, the closure comprising an upper portion and a lower portion, the lower portion having a lower lateral surface, the lower portion being adapted to be inserted into or onto the opening of the container and two grooves provided on the lower lateral surface or on the container or on an intermediate closure and adapted to receive two respective sealing members, the two grooves being separated by a predetermined distance, the two sealing members provided in the two respective grooves, the two sealing members being adapted to provide sealing between the lower lateral surface and the container surface, wherein the lower lateral surface, the container surface and the two auxiliary sealing members together define an annular space and a barrier sealant is placed in the annular space.

In one embodiment of the invention, the sealing members are selected from a group consisting of o-rings, barbs or rings made up of synthetic polymers or curable compositions.

In one embodiment of the invention, the assembly further comprises a clamping arrangement adapted to clamp the closure with the container.

In one embodiment of the invention, the closure further comprises one or more passages connecting one or more respective sealant receiving ports in the upper portion with one or more respective lateral openings, between the two grooves, in the lower lateral surface.

In one embodiment of the invention, the assembly further comprises one or more plugs provided at the one or more respective sealant receiving ports, the one or more plugs being adapted to prevent the barrier sealant from escaping through the one or more respective passages.

In one embodiment of the invention, the closure is made up of material selected from a group consisting of metals, ceramics, glasses and polymers.

In one embodiment of the invention, the upper portion further comprises a lip portion, a width of the lip portion being greater than a width of the opening of the container.

In one embodiment of the invention, the upper portion further comprises a second cavity.

In one embodiment of the invention, the second cavity is adapted to receive one or more of an environmental indicator and an environmental control element.

In one embodiment of the invention, the assembly further comprises a second closure having a substantially flat disk fastened to the container and placed above the closure, comprising a second closure.

In one embodiment of the invention, the flat disk further comprises a flat glass plate placed between the closure and the container.

In one embodiment of the invention, the upper portion further comprises two auxiliary grooves provided at an upper surface of the upper portion, the two auxiliary grooves being adapted to receive two respective auxiliary sealing members, wherein the two auxiliary grooves are oriented in a direction normal to the surface.

In one embodiment of the invention, the one or more passages further connect the one or more respective sealant receiving ports in the upper portion with one or more respective upper openings, between the two auxiliary grooves, in the upper surface.

In one embodiment of the invention, the assembly further comprises the two auxiliary sealing members adapted to provide sealing between a lower plate surface of the flat glass disk and the upper surface, wherein the upper surface, the lower disk surface and the two auxiliary sealing members define an auxiliary annular space.

In one embodiment of the invention the closure further comprises one or more content exchange passages connecting the cavity to one or more respective content exchange ports in the upper portion, the one or more content exchange passages being adapted to receive and deliver content and possibly inert material in and out of the container, respectively.

In one embodiment of the invention, the assembly further comprises one or more content exchange valves provided at the one or more respective content exchange ports and adapted to open and close the one or more respective content exchange passages to the atmosphere.

In one embodiment of the invention, the assembly further comprises a longitudinal tension member provided within the container and cavity within and adapted to arrest a motion of the closure with respect to the container.

In one embodiment of the invention, the barrier sealant is selected from a group consisting of an aqueous solution, a non-aqueous solution, grease, epoxy, acrylic, polysulfide, UV-cure, time-cure, polyurethane and adhesive.

According to a second aspect of the present invention, there is provided a closure for sealing of a container, the closure comprising an upper portion and a lower portion, the lower portion having a lower lateral surface, the lower portion being adapted to be inserted into the opening of the container and two grooves provided on the lower lateral surface and adapted to receive two respective sealing members, the two grooves being separated by a predetermined distance.

In one embodiment of the invention, the closure further comprises one or more passages connecting one or more respective sealant receiving ports in the upper portion with one or more respective lateral openings, between the two grooves, in the lower lateral surface.

In one embodiment of the invention, the closure further comprises one or more plugs provided at the one or more respective sealant receiving ports, the one or more plugs being adapted to prevent a barrier sealant from escaping through the one or more respective passages.

In one embodiment of the invention, the closure is made up of material selected from a group consisting of metals, ceramics, glasses and polymers.

In one embodiment of the invention, the upper portion further comprises a lip portion, a width of the lip portion being greater than a width of the opening of the container.

In one embodiment of the invention, the upper portion further comprises a second cavity.

In one embodiment of the invention, the second cavity is adapted to receive one or more of an environmental indicator and an environmental control element.

In one embodiment of the invention, the upper portion further comprises two auxiliary grooves provided at an upper surface of the upper portion, the two auxiliary grooves being adapted to receive two respective auxiliary sealing members, wherein the two auxiliary grooves are oriented in a direction normal to the two grooves.

In one embodiment of the invention, the one or more passages further connect the one or more respective sealant receiving ports in the upper portion with one or more respective upper openings, between the two auxiliary grooves, in the upper surface.

In one embodiment of the invention, the closure further comprises one or more content exchange passages connecting the cavity to one or more respective content exchange ports in the upper portion, the one or more content exchange passages being adapted to receive and deliver content in and out of the cavity, respectively.

BRIEF DESCRIPTION OF THE DRAWINGS

At least one example of the invention will be described with reference to the accompanying drawings, in which.

It should be noted that the same numeral represents the same or similar elements throughout the drawings.

DETAILED DESCRIPTION OF THE EMBODIMENTS

Figure 1A:
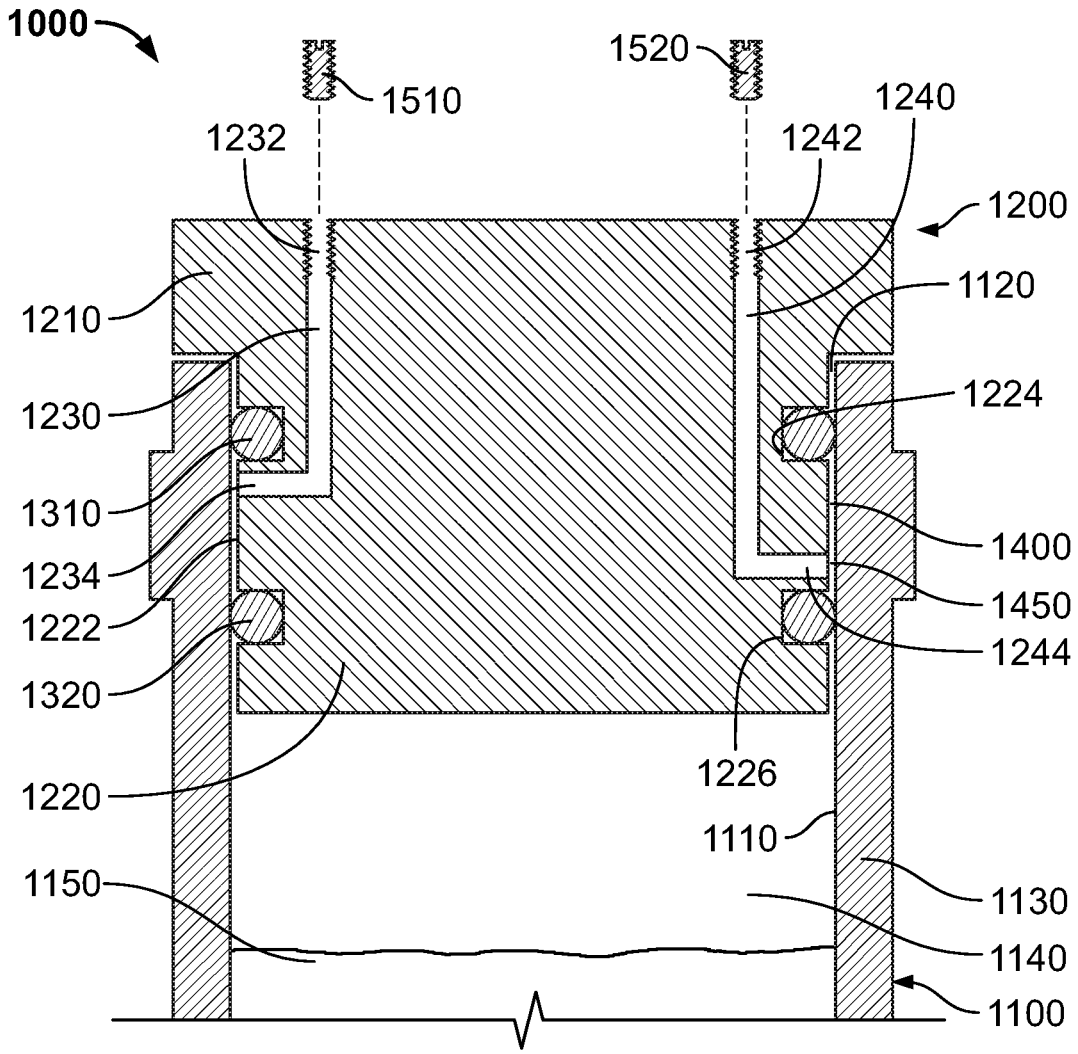
FIG. 1A illustrates a cross-sectional view of an assembly of a container, having a relatively long and relatively narrow neck, with a closure, in accordance with an embodiment of the present invention.

The approach described here for sealing glass, metal, ceramic, polymer or similar containers is to use a barrier sealant that conforms to any imperfections in mating surfaces to form a substantially impermeable seal between a container material and a closure.

If the barrier sealant is chosen to have suitable properties, in particular, low permeability, it can bring dramatically improved performance to a system comprising a container with a closure, by replacing or augmenting a polymer seal. In general, the barrier sealant also known as a trapping liquid or a fluid barrier, together with other sealing members, will comprise a multilevel, multicomponent seal. A minimum of two sealing members are required to isolate the barrier sealant from interior and exterior environments, while the barrier sealant itself forms a third seal. Such seals can be configured in series, further increasing the number of sealing levels and impedance to migration. It is possible to choose barrier sealants that provide much higher impedance to ingress and egress than most polymers provide. Further, because many liquids flow readily, they easily conform to spaces that have much larger aspect ratios than are practical with polymer and plastisol seals, thereby reducing the mechanical precision required for sealing, while increasing resistance to ingress and egress. The large aspect ratio magnifies the diffusion barrier to a much higher impedance or resistance than is possible with the typical short plastisol diffusion paths in conventional container closures. Further, barrier sealants can maintain intimate contact for indefinite periods with the glass, metal, ceramic and plastic surfaces without large forces and pressures.

The general approach of using barrier sealant seals particularly is compatible with reuse of containers, which often represent a substantial investment of energy, a proxy for money on your planet. Discarding containers after one use generally is not a sustainable practice. Avoiding the energy expense of manufacturing and shipping containers is attractive, even if the alternative is to recycle the container material. In the case of glass containers, the energy required to clean, re-melt and reprocess the glass for recycling is a large fraction of the overall energy investment that has been made in transporting the materials, fusing the glass or metal, molding the container and transporting the container to an end user. Repeating those steps with recycled materials is only marginally more efficient than doing it with virgin materials. It would be preferable to clean the containers and reuse them.

If containers can be reused indefinitely, the energy waste of fabricating and shipping new containers, while landfilling used ones, can be avoided in preference to cleaning and reuse. Similarly, for metal, ceramic and polymer containers, indeed any container, energy is expended in resource extraction, manufacturing and transportation, which energy and investment can be recaptured more fully by reusing the container instead of discarding or recycling it. If both the containers and closures are readily cleaned and reused, it will be a boon to commerce, particularly in commodities, which represent a large fraction of economic activity and tend to trade at a small premium to cost of production.

Objects of the present inventions include providing a relatively inexpensive and high quality closure and method of sealing a container, in a way that is readily opened and readily resealed. By high quality is meant able to exclude contamination by migration from the ambient, which may include oxygen, moisture or other gases, vapors, liquids or solids present in the environment. Also meant by high quality barrier is ability to block egress of contents, vapors and volatiles from the container. The present invention provides significant improvement over the prior art by employing one or more barrier sealant layers and by the shaping the barrier sealant layer as a thin layer having a high or large aspect ratio. The present inventions provide new and simple methods and features for installation, maintenance, removal and replacement of fluid barriers. Because of the large aspect ratio, the path for diffusion of contaminants to reach the contents is long, while the area for entry into the path for diffusion is narrow. The path for constituents of the contents to diffuse through the barrier sealant and escape also is equally long, while the area for entry into the path for diffusion out also is equally narrow and the path through the material is as thin and long as possible. Thin is defined in terms of aspect ratio. The preferred aspect ratio is greater than 50. These improvements provide a significant advance in the state of the art.

Seal geometries in the following drawings are related by symmetry to be essentially the same topological features on a variety of container shapes. It will be understood by those skilled in the art that there are an infinite number of equivalent symmetry transforms that alter the multilevel seal geometry to fit any container that has mathematically well-behaved surfaces. The following embodiments are illustrative and not meant to limit the application to any particular geometry.

FIG. 1A illustrates a cross-sectional view of an assembly 1000 of a container 1100, having a relatively long and relatively narrow neck 1130, and a closure 1200, in accordance with an embodiment of the present invention. The container 1100 may be for example a glass, ceramic, metal or polymer container. The container 1100 has an inner container surface 1100 defining a cavity opening to ambient through an opening 1120. The container 1100 is further envisaged to have a headspace 1140 between contents 1150 and the closure 1200. Typically, the headspace 1140 is evacuated using a vacuum pump, which results in atmospheric pressure being exerted onto the closure 1200, holding the closure 1200 in a neck 1130 of the container 1100, thereby diminishing a need for any retention features.

In various embodiments, the closure 1200 may be in the form of a plug, disk or stopper, which may be retained by standard threaded arrangements. In other embodiments, the closure 1200 resembles a wine cork, and may be retained by a clip, clamping arrangements or wrappings as commonly practiced in the wine trade. Further, in various embodiments, the closure 1200 is made up of materials selected from a group consisting of metals, ceramics, glasses and polymers. The body of the closure 1200 may be shaped by conventional operations such as turning on a lathe, so that it cannot fall into the neck 1130 of the container 1100, which is particularly important in cases where the contents 1150 are vacuum packed by removing gas from the headspace 1140. Alternatively, the headspace 1140 may be filled with an inert gas such as nitrogen or argon.

The closure 1200 includes an upper portion 1210 and a lower portion 1220. The lower portion 1220 has a lower lateral surface 1222. The lower portion 1220 is adapted to be inserted into the opening 1120 of the container 1100. Further, two grooves 1224 and 1226 have been provided on the lower lateral surface 1222. The closure 1200 may be fabricated from metal, ceramic, glass, plastic, polymer or any suitable combination thereof. Generally speaking, metal, ceramic, glass and certain polymers are more favorable from the point of view of low permeability. Parts of this type have been successfully manufactured using a lathe followed by drill press operations, although many other manufacturing techniques also may be used. The closure 1200 may be fabricated by a series of lathe operations. Turning the outer diameters, the two grooves 1224 and 1226, cut-off and facing are simple lathe operations.

Off-axis drilling and cross-drilling can be accomplished readily with either a C-axis lathe or by using appropriate fixtures in lathes or other machines. Thus, under favorable circumstances, all of the drilling and tapping operations may be carried out on a lathe. Alternatively, all of the features of the closure 1200 may be machined using a mill, or only the portion which are most suited to the available types of machinery. It will be understood by those skilled in the art that aluminum, glass, polymers, ceramics and other materials may be fabricated by die casting, molding, stamping and countless other mass manufacturing techniques. The best choice of manufacturing approach will depend on many factors, particularly the number of pieces to be produced. It has been found that many of the common aluminum alloys are suitable materials.

The preferred materials of construction for the closure 1200 are metal, glass, ceramic, and polymer, either singly, or in combination with themselves and other materials. Materials having similar low permeability or materials having other permeability properties may be substituted as circumstances dictate or allow. Among metals, aluminum is recognized as a good choice for its low cost, easy machining, low toxicity and corrosion resistance, but many other metals or alloys, including, but not limited to, stainless steel, brass, titanium, silver, nickel, tin, and lead, may be appropriate for applications where coefficient of expansion matching or resistance to corrosion by a particular commodity or environment are required. Many other metals, ceramics or plastics also can be used, with the optimum choice depending on the chemical properties of the materials to be stored, the coefficient of expansion of the container, strength, durability, ease of fabrication and cost considerations.

The two grooves 1224 and 1226 are adapted to receive two respective sealing members 1310 and 1320. The two grooves 1224 and 1226 are separated by a predetermined distance. It will be appreciated by those skilled in the art that surfaces at the bottoms of the two grooves 1224 and 1226 of the closure 1200 where the two sealing members 1310 and the 1320 contact should be polished to improve sealing quality. The two sealing members 1310 and 1320 also may be constituted of epoxy or a variety of other molded-in-place sealing materials to provide substantially the same trapping effect as o-rings provide for the purposes of the present invention. Molded plastic ring structures with knife edges or injected rings of curable polymers are feasible embodiments of the two sealing members 1310 and 1320. Additionally, the two sealing members 1310 and 1320 may be envisaged to have round, square or other profiles.

The two sealing members 1310 and 1320 being provided in the two respective grooves 1224 and 1226, are adapted to provide sealing between the lower lateral surface 1222 and the inner container surface 1110. In various embodiments of the invention, the sealing members 1310 and 1320 are selected from a group consisting of o-rings, rings or barbs made up of synthetic polymers. As can be seen also from FIG. 1A. the lower lateral surface 1222, the inner container surface 1110, particularly at the neck inner surface 1120, and the two auxiliary sealing members 1310 and 1320 together define an annular space 1400. A barrier sealant 1450 has been provided in the annular space 1400. In various embodiments, the barrier sealant is selected from a group consisting of an aqueous solution, a non-aqueous solution, grease, epoxy, acrylic, polysulfide, UV-cure, time-cure, polyurethane and adhesive.

Three levels of sealing are provided, where two sealing members 1310 and 1320 trap the barrier sealant 1450 in the annular space 1400. The two sealing members 1310 and 1320 seal against, for example, a smooth glass inner container surface 1110. A first sealing member 1310 traps the barrier sealant 1450 on the side toward the external ambient environment, while a second sealing member 1320 traps the barrier sealant 1450 on the side toward the headspace 1140 and the contents 1150. The barrier sealant 1450 in an annular space 1400 constitutes an additional seal with very high barrier properties.

It should be understood that the assembly 1000 comprising the container 1100, the closure 1200 and the barrier sealant 1450 can be modeled in terms of an electric circuit. The impedance of the two sealing members 1310 and 1320, and the barrier sealant 1450 as well as any additional seals or closures, to the flow of environmental components or the contents 1150 can be treated as a resistance or impedance to flow, in this case of material, which is equivalent in form and calculations to the flow of current through electrical resistance. The partial pressure or chemical activity of any component on one or both sides of the two sealing members 1310 and 1320 and the barrier sealant 1450 can be treated as a voltage tending to drive flow across the impedance. The headspace 1140 and the contents 1150 comprise the equivalent of capacitances, while the external atmosphere is a battery of infinite capacity and constant voltage with respect to oxygen. The atmospheric partial pressure of water vapor varies over time, but usually can be approximated as an average constant for any locale, because the rate of ingress or egress is small enough relative to container capacity that the relevant timescale is months and years, rather than hours and days. If a conventional closure on the container 1100 has added in series with it another closure, the impedances are additive. In the case where both impedances are equal before combination, the rate of leakage of environmental contaminants will be reduced by ½ with both closures acting in series.

In various embodiments, the closure 1200 further comprises one or more passages 1230 and 1240 connecting one or more respective sealant receiving ports 1232 and 1242 in the upper portion 1210 with one or more respective lateral openings 1234 and 1244, between the two grooves 1224 and 1226, in the lower lateral surface 1222. The one or more passages 1230 and 1240 are provided for injection of the barrier sealant 1450 into the annular space 1400 between the two sealing member 1310 and 1320. If a passage, for example a first passage 1230, is evacuated at the same time as the airspace of the container 1100, or the headspace 1140, by the use of vacuum packing, then the barrier sealant 1450 may be injected under vacuum, and driven to completely fill the annular space 1400, as well as one or more of the one or more passages 1230 and 1240, by atmospheric pressure behind the barrier sealant 1400. Alternatively, the area of the closure 1200 between the sealant members 1310 and 1320 may be immersed in the barrier sealant 1450 before the closure 1200 is inserted through the opening 1120 of the container 1100. This can be done at any pressure from vacuum to thousands of pounds per square inch, depending on what other process engineering constraints apply. Thus, the annular space may be filled with barrier sealant 1450 without requiring the use of any optional passages 1230 or 1240.

It is possible to fill the annular space 1400 with the barrier sealant 1400 without utilizing any passages 1230 or 1240. The steps are to place the entire assembly 1000 in a vacuum chamber and remove substantially all of the air. After the air has been thoroughly removed from the assembly 1000, including the as-yet unformed annular space 1400, the headspace 1140 optionally can be backfilled with any suitable gas. In various embodiments the gas is nitrogen or argon. The closure 1200 may be inserted to make a first seal at the second sealing member 1320, then the annular space 1400 is pumped full of the barrier sealant 1450 as the closure 1200 moves to engage the neck 1130 at the first sealing member 1310. Alternatively, the closure 1200 and the neck 1130 may be immersed in the barrier sealant 1450 and assembled together thereby completely filling the annular space 1400 with barrier sealant 1450 without a requiring the use of one or more passages 1230 and 1240. The closure 1200 may be inserted with the container 1100 held in a vacuum chamber, such that little to no air is in the headspace 1140 is in contact with the contents 1150. This will have the effect of removing air from the headspace 1140, replacing the air with vacuum.

In various embodiments, the assembly 1000 comprises one or more plugs 1510 and 1520 provided at the one or more respective sealant receiving ports 1232 and 1242. The one or more plugs 1510 and 1520 are adapted to prevent the barrier sealant 1450 from escaping through the one or more respective passages 1230 and 1240. Threaded features may be provided at the one or more respective sealant receiving ports 1232 and 1242 to retain the one or more plugs 1510 and 1520. The one or more plugs 1510 and 1520 may be driven into threads at the one or more respective sealant receiving ports 1232 and 1242, having threaded features, using a hex key, spline key or other tool, as appropriate. Alternatives to threaded features include pressed in metal, plastic or elastomer pins, with or without barbs or other retention means. In cases where the barrier sealant 1450 is a curable sealant, it generally is unnecessary to block the escape. The friction of the two sealing member 1310 and 1320 usually is sufficient to overcome gravity, but may not be able to resist gas pressures that result from vacuum, heating or cooling of gas in the headspace 1140, or outgassing of the contents 1150.

Figure 1B:
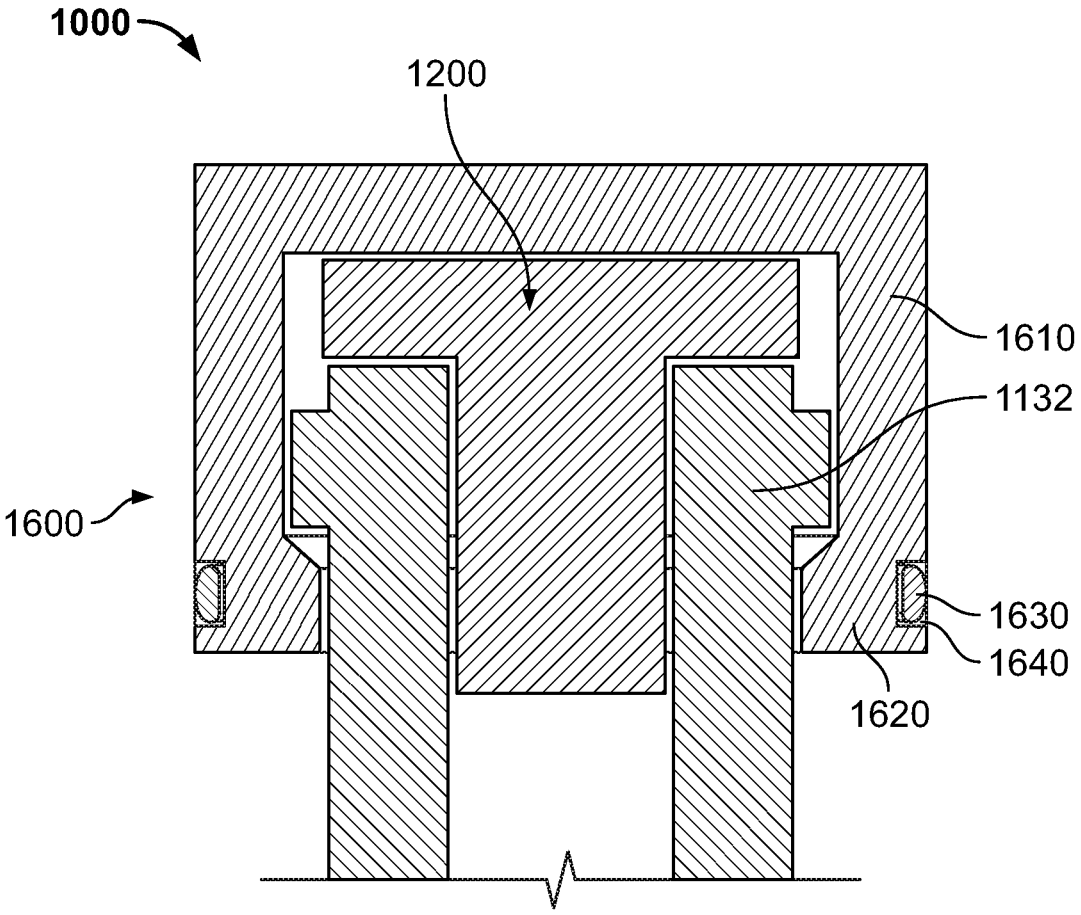
FIG. 1B illustrates the cross-sectional view of the assembly of the container of FIG. 1A, with the closure, in accordance with another embodiment of the present invention.

FIG. 1B illustrates the cross-sectional view of the assembly 1000 of the container 1100 of FIG. 1A, and the closure 1200, in accordance with another embodiment of the present invention. A clamping arrangement 1600 adapted to clamp the closure 1200 with the container 1100 has been provided. A clamp 1610 is used to retain the closure 1200 from being ejected by pressure from the contents 1150 and the headspace 1140. The clamp 1610 may be retained by a ridge 1620 that engages a ring feature 1132 on the bottle neck 1130. A tension member 1630 such as a zip-tie, hose clamp or wire tie may be installed in a groove 1640 to insure that the ridge 1620 cannot slip over the ring feature 1132 until such time as the user wishes to access the contents 1150, and releases the tension of the member 1630.

Figure 2A:
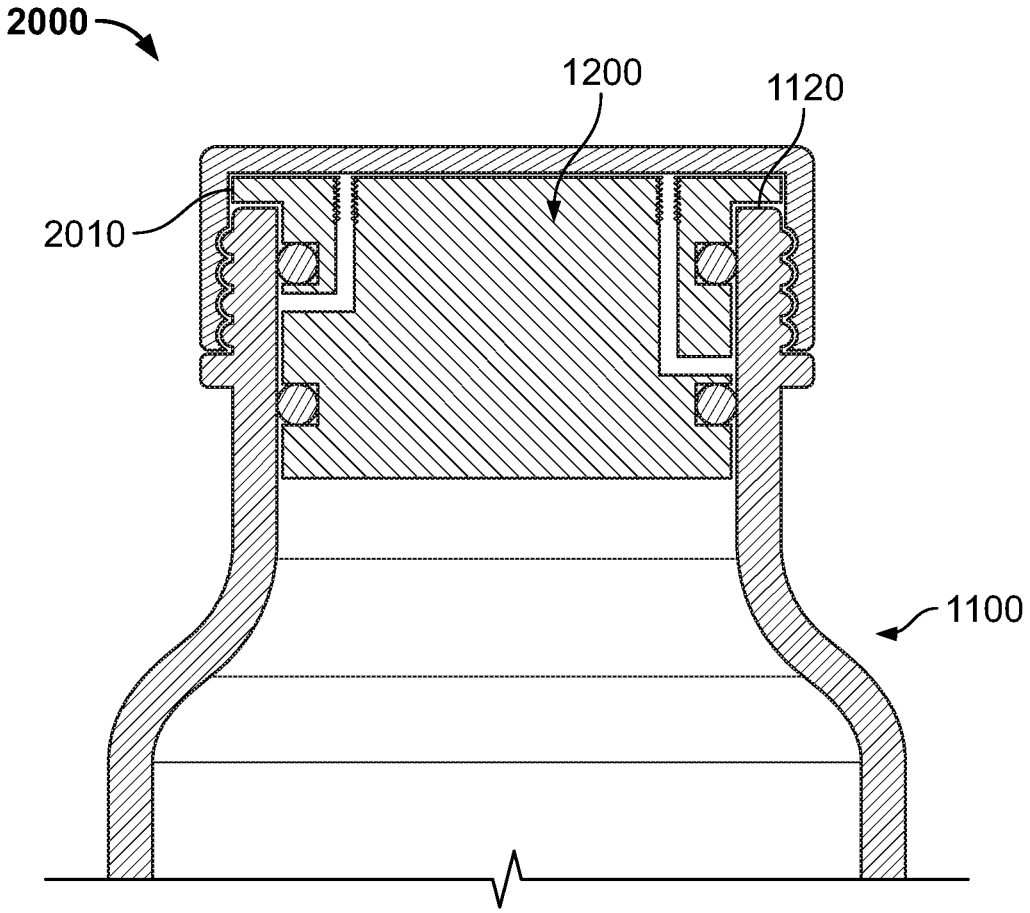
FIG. 2A illustrates a cross-sectional view of an assembly of a container, having a wide opening, and a closure, in accordance with an embodiment of the present invention.

FIG. 2A illustrates a cross-sectional view of an assembly 1000 of the container 1100, having a wide opening, and the closure 1200, in accordance with an embodiment 2000 of the present invention. This embodiment is substantially identical to the embodiment of FIG. 1, except that the shape or aspect ratio of the closure 1200 is changed from a long plug or stopper shape to a disk shape. The larger surface area of the opening 1120 encourages innovations that would not fit onto the closure of FIG. 1. Because of the larger area of the closure 1200, it is much easier to be upset by gas pressures from the headspace 1140, and vacuum may drive it into the neck 1130 damaging material of the container 1100. Therefore, the upper portion 1210 further comprises a lip portion 2010, a width of the lip portion 2010 being greater than a width of the opening 1120 of the container 1100. The purpose of the lip portion 2010 is to bear the vertical pressure of ambient atmosphere.

Figure 2B:
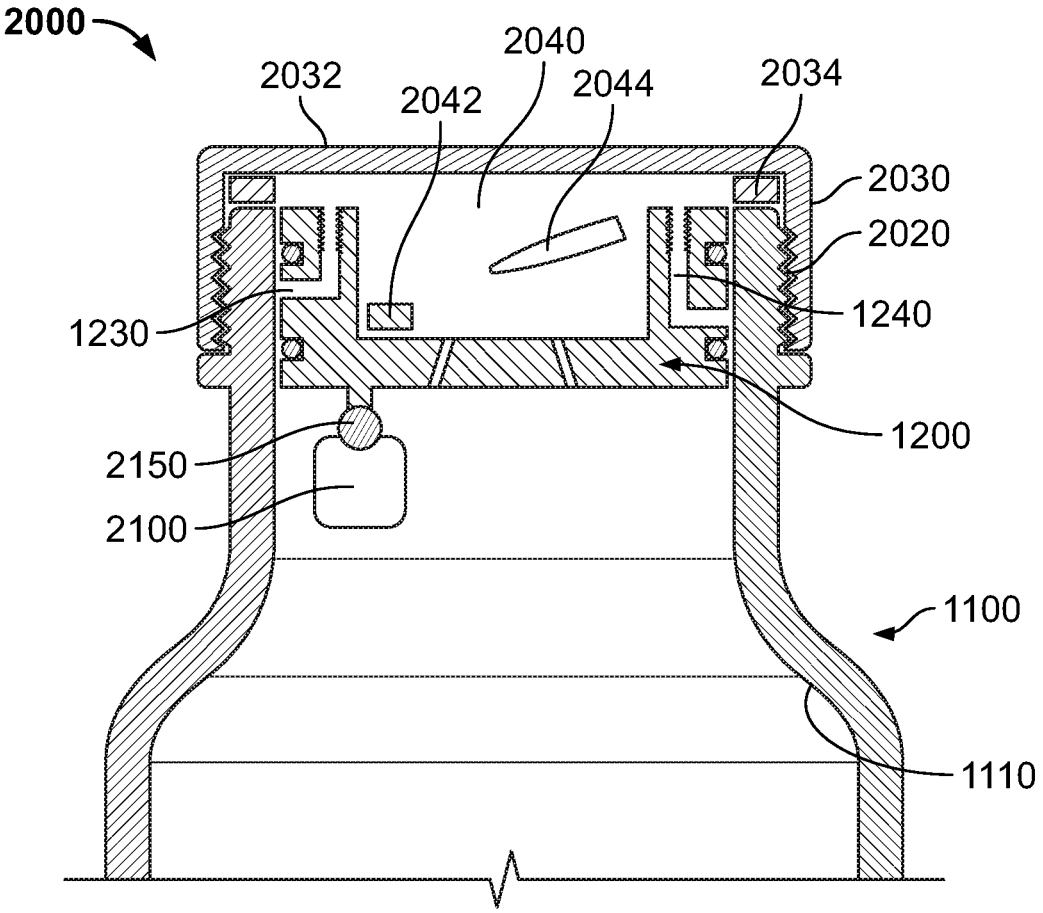
FIG. 2B illustrates the cross-sectional view of the assembly of the container of FIG. 2A, with the closure, in accordance with another embodiment of the present invention.

FIG. 2B illustrates the cross-sectional view of the assembly 1000 of the container 1100 of FIG. 2A, and the closure 1200, in accordance with another embodiment of the present invention. As can be seen from the FIG. 2A, the assembly 1000 further comprises a second closure 2030 having a substantially flat disk 2032 fastened to the container 1100 and placed above the closure 1200. Jar threads 2020, normally are used to hold a substantially flat closure having a plastisol sealing gasket 2034 on top of the container 1100. The jar threads 2020 may be used with the substantially flat disk 2032 in conjunction with the closure 1200 described here, such that the barrier sealant 1450 will present a further impedance beyond what is provided by plastisol sealing gasket 2034 to the undesirable flows of contaminants from the environment, and egress of components from the contents 1150.

In one embodiment of the invention, the upper portion 1210 further comprises a second cavity 2040. The second cavity 2040 is adapted to receive one or more of an environmental indicator 2042 and an environmental control element 2044, such as humidity indicator and oxygen absorbers, respectively.

The method of manufacture of flatter version of the closure 1200 may be different series of operations, but as with the example in FIG. 1, the overall shape and many of the features can be produced with simple lathe operations. For example, pressed sheet metal versions are a likely step in the direction of low-cost mass manufacture for the embodiments of FIG. 2, as the two grooves 1224 and 1226 may be formed in a pressing operation that makes the closure 1200 from very inexpensive sheet metal. The key difference is that the much larger neck 1130 of the container 1100 requires a different aspect ratio for a part of very similar underlying geometry to the embodiment of FIG. 1. The disk 1200 must have acceptable dimensions for the two sealing member 1310 and 1320 to contact the inner container surface 1110. In this embodiment, the diameter of the closure 1200 is expanded to match the wide opening 1120 of the container 1100. If the inner container surface 1110 has significant taper, it is preferred that the closure 1200 also match the taper angle of inner container surface 1110 as closely as feasible. The advantage of closely matching the taper is that the aspect ratio of the resulting annular space 1400 and the corresponding barrier sealant 1450 is maximized, thereby reducing diffusion from the environment to the headspace 1140 and vice versa.

Again, the preferred material of manufacture for the closure 1200 is an aluminum alloy, for example, 6061, but many other materials may be substituted successfully, depending on the application. For example, aluminum has a relatively large coefficient of thermal expansion (CTE) of about 24 ppm/C that is a less than ideal match to glass. Typical soda lime glasses have CTE's in the range of 7 ppm. Depending on the temperature range of use, coefficient mismatches may necessitate larger clearances to avoid breakage, and those clearances will have to accommodate the range of acceptable compression for the two sealing members 1310 and 1320, which often are o-rings. Allowing for clearance over temperature will undesirably reduce the aspect ratio of the barrier sealant 1450 in the annular space 1400. For containers that will experience large variations of temperature, such as shipments to polar regions or hot desert regions, it may be advantageous to use a material that has a closer match to the coefficient of thermal expansion of glass, or to make the container from aluminum. For example, stainless steel has a coefficient of thermal expansion (CTE) of about 15 ppm/C, while the soda lime glass commonly used in bottles, jugs and jars of commerce has a typical CTE of 7 ppm/C. This difference of 8 ppm/C is a much better match of CTE than aluminum to glass, for which the difference is close to 17 ppm/C. A further advantage of stainless steel is that it may be readily pressed into sheet metal structures, which inherently have more flexibility than solid aluminum disks. The compliance of a springy sheet metal disk is less likely to break glass, irrespective of the coefficient mismatch.

As before, the one or more passages 1230 and 1240 may be provided to facilitate placement of the barrier sealant 1450 between the two sealing members 1310 and 1320. In the case of a sheet metal version of the closure 1200, the one or more passages 1230 and 1240 may be attached by brazing or welding or the method of installing the barrier sealant 1450 into the annular space 1400 under vacuum must be employed. Hard solder or brazing is a feasible approach to installing a machined portion having one or more passages 1230 and 1240 onto a sheet metal disk structure.

The following description is with regard to FIG. 2A, 2B, which shows the closure 1200 suited for insertion into the neck 1130 of the container 1100 with a wide opening 1120. The body of the closure 1200 may be shaped by conventional operations such as pressing or turning on a lathe, so that it cannot fall into the container 1100, which is particularly important in cases where the contents 1150 are vacuum packed under the evacuated headspace 1140 and/or under evacuated second cavity 2040. For a wide closure 1200, the force of air pressure against the vacuum combined with the wedge angle may be sufficient to break the glass neck 1130. The design trade-space for the two grooves 1224 and 1226 is well understood with respect to compression, seal quality and force, but generally speaking o-rings should be compressed to about 85% of the cordstock diameter, with sufficient groove width to accommodate the resulting expansion in the perpendicular axis. The tradeoff between cost, size, o-ring barrier properties and tolerances of the mating parts will affect what o-ring cordstock diameter is optimal, where larger o-rings offer a more favorable range of accommodation at the expense of more diffusion. With suitable fixtures, all of the drilling and tapping operations on the closure 1200 may be carried out on a lathe, although this is not the generally preferred method of manufacture for relatively flat parts. Alternative methods of manufacture will be apparent to those skilled in the art. There are many correct approaches, but the most suitable method depends of scale of production.

Figure 3A:
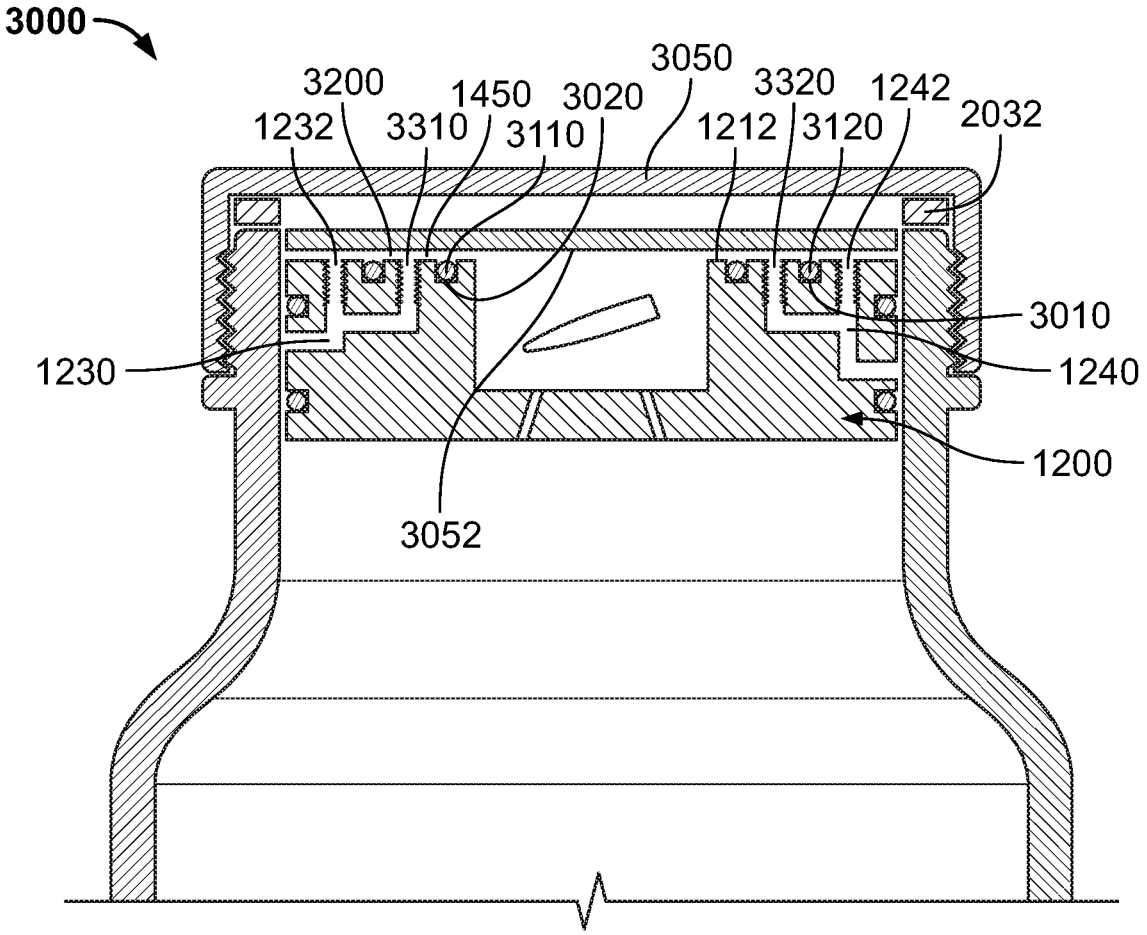
FIG. 3A illustrates a cross-sectional view of an assembly of a container, having a wide opening, with a closure, in accordance with yet another embodiment of the present invention.

FIG. 3A illustrates a cross-sectional view of the assembly 1000 of the container 1100, having a wide opening, and the closure 1200, in accordance with yet another embodiment 3000 of the present invention. Here, a flat glass plate 3050 placed between the substantially flat disk 2032 and the closure 1200. Further, the upper portion 1210 further comprises two auxiliary grooves 3010 and 3020 provided at an upper surface 1212 of the upper portion 1210 of the closure 1200. The two auxiliary groves 3010 and 3020 are adapted to receive two respective auxiliary sealing members 3110 and 3120. Also, the two auxiliary grooves 3010 and 3020 are oriented in a direction normal to the two grooves 1224 and 1226. The two auxiliary sealing members 3110 and 3120 are adapted to provide sealing between a lower plate surface 3052 of the flat glass plate 3050 and the upper surface 1212, wherein the upper surface 1212, the lower plate surface 3052 and the two auxiliary sealing members 3110 and 3120 define an auxiliary annular space 3200. The one or more passages 1230 and 1240 further connect the one or more respective sealant receiving ports 1232 and 1242 in the upper portion 1210 with one or more respective upper openings 3310 and 3320, between the two auxiliary grooves 3010 and 3020, in the upper surface 1212.

The flat glass plate 3050 is much easier to remove and replace without having to replace the majority of the barrier sealant 1450. The auxiliary annular space 3200 can have a much higher aspect ratio, providing a higher impedance to the entry of contaminants into the container 1100. Another advantage of auxiliary annular space 3200 is that it allows the use of the flat glass plate 3050, which brings several further significant advantages. First, the flat glass plate 3050 made by a float process is very inexpensive, smooth to the nanometer level and flat to a few wavelengths of light per inch. Thus, the auxiliary annular space 3200 can be much thinner, i.e., manufactured to much tighter tolerances, leading to a very high impedance for entry of contaminants, or escape of the contents 1150. A further advantage of the flat glass plate 3050 is that it can be clear to allow viewing of the environmental indicators 2044 placed in the second cavity 2040 to report on the condition of the contents 1150 and the headspace 1140. To maintain sealing pressure of the flat glass plate 3050 against the two auxiliary sealing members 3110 and 3120 as well as the barrier sealant 1450, auxiliary annular space 3200 may be evacuated to create a pressure differential that maintains a net 14.7 pounds per square inch of atmospheric pressure against the flat glass plate 3050 in the auxiliary annular space 3200.

Figure 3B:
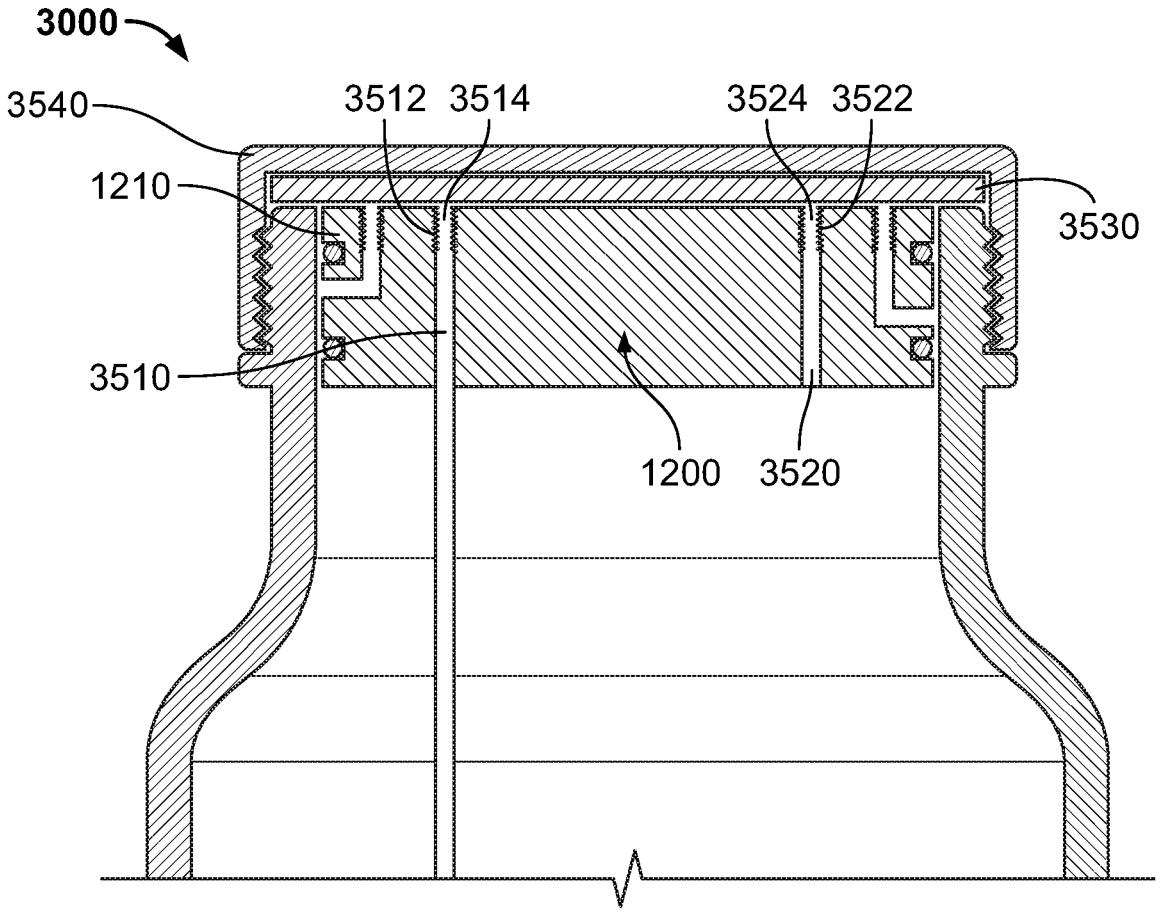
FIG. 3B illustrates the cross-sectional view of the assembly of the container of FIG. 3A, with the closure, in accordance with yet another embodiment of the present invention.

FIG. 3B illustrates the cross-sectional view of the assembly 1000 of the container 1100 of FIG. 3A, and the closure 1200, in accordance with yet another embodiment of the present invention. The closure 1200 further comprises one or more content exchange passages 3510 and 3520 connecting the cavity to one or more respective content exchange ports 3512 and 3522 in the upper portion 1210. The one or more content exchange passages 3510 and 3520 are adapted to receive and deliver the content 1150 in and out of the cavity, respectively. Additionally, one or more content plugs 3514 and 3524 may be placed to plug the flow of contents 1150 from the one or more respective content exchange ports 3512 and 3522, respectively. A conventional closure liner 3530 provides an additional layer of sealing, being clamped firmly in place by a conventional screw-on cap 3540.

Figure 4:
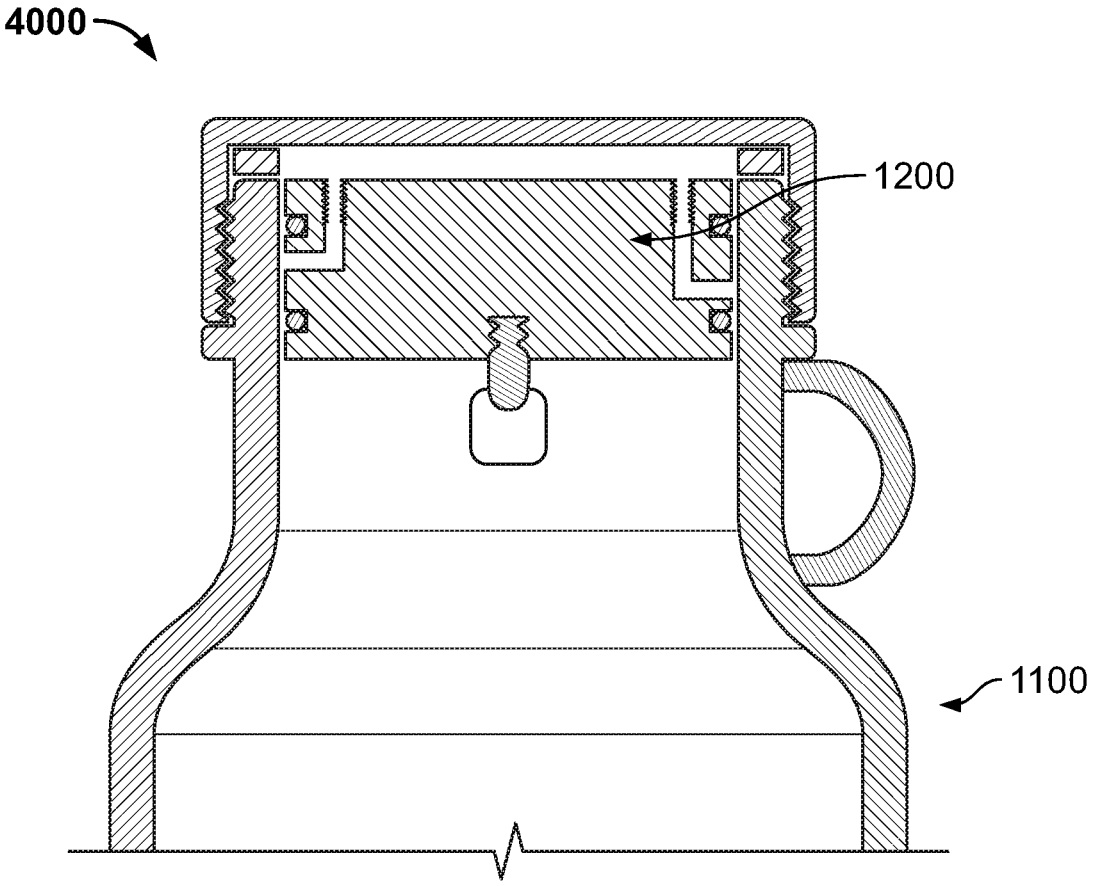
FIG. 4 illustrates a cross-sectional view of an assembly of a container in form of a jug, with a closure, in accordance with an embodiment of the present invention.

FIG. 4 illustrates a cross-sectional view of the assembly 1000 of the container 1100 in form of a jug, and the closure 1200, in accordance with an embodiment of the present invention. Typically, glass jugs are manufactured in the U.S. in 128, 64 and 32 ounce sizes, with most having the same 38 mm cap. The diameter of the closure 1200 is expanded relative to FIG. 1 and reduced relative to FIG. 2 to match the jug 1100 neck finish, including taper. Again, the preferred material of manufacture for the closure 1200 is aluminum, but many other materials may be substituted successfully, depending on the particular application. A piece of tubing or pipe may be substituted for the container 1100 and the neck 1130 and used as an inexpensive and well-sealed container. The piece of tubing can be closed at the other end by a variety of means, including welding, adhesive or a second closure equivalent to the closure 1200.

Figure 5:
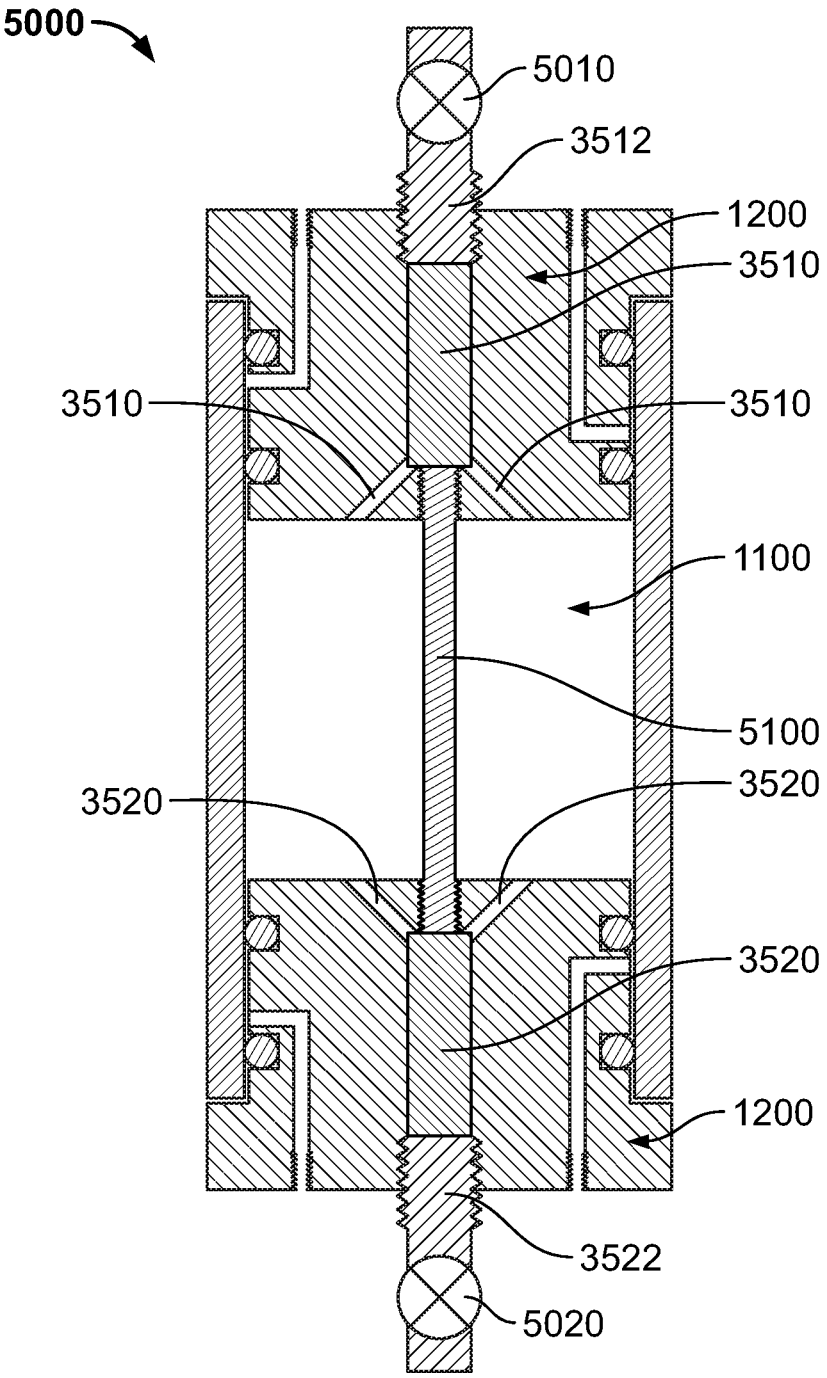
FIG. 5 illustrates a cross-sectional view of an assembly of a container in form of a section of tubing or pipe, with a closure, in accordance with an embodiment of the present invention.

FIG. 5 illustrates a cross-sectional view of an assembly of a container in form of a piece of tubing, and at least one closure, in accordance with an embodiment of the present invention. Metal, glass, ceramic and polymer or plastic tubing are attractive from the point of view of being inexpensive, mass-produced forms that can be used for a variety of purposes, including packaging, storage and shipping of commodities. A piece of tubing, cut to a suitable length, can be closed at one end with the closure 1200. The other end may be closed by a variety of means, including a similar closure 1200, welding, crimping, or many other's obvious to those skilled in the art. A closure 1200 can be used at the opposite end, or the opposite end may be closed by a fusion process in the case of glass tubing, by a welding, brazing or soldering operation in the case of metal tubing or by a sintering operation in the case of ceramic tubing. A plastic tube or pipe may be solvent welded. Almost any tube or pipe may be sealed with epoxy or other organic resin.

As shown in FIG. 5, the assembly 1100 further comprises one or more content exchange valves 5010 and 5020 provided at the one or more respective content exchange ports 3512 and 3522 and adapted to open and close the one or more respective content exchange passages 3510 and 3520 to the atmosphere. Use of the one or more content exchange valves 5010 and 5020 may be more convenient because it avoids the need to clean and replace the barrier sealant 1450 around the closure 1200. The one or more content plugs 3514 and 3524 also can be removed to access the contents 1150. Because one or more content exchange valves 5010 and 5020 generally are mass manufactured from metal, the internal sealing of valves is orders of magnitude more effective than sealing provided by the plastisol seals or polymer liners in conventional closures.

The use of the barrier sealant 1450 may be extended to cases where the barrier sealant 1450 is moved in the course of normal operation to open and close the one or more respective content exchange passages 3510 and 3520. The one or more content exchange passages 3510 and 3520 through the one or more content exchange valves 5010 and 5020 may be blocked by the barrier fluid sealant while the one or more content exchange valves 5010 and 5020 are closed, thereby improving the overall sealing function of the one or more content exchange valves 5010 and 5020. For example, in the case of valves that use polymer o-rings for sealing or are not manufactured to tight mechanical tolerances that effect nearly perfect sealing. The closure 1200 itself on the container 1100 essentially is an on-off valve that either blocks egress of the contents 1150 from the container 1100 when it is closed, as well as blocking ingress of environmental components, or permits the contents 1150 of the container 1100 to be poured or otherwise accessed when it is open. Invariably, when the container 1100 is open, the environment and the contents 1150 interact. Many closures with valves built in are known for use in handling certain commodities, particularly gases and volatile liquids, but none of those valves, or very few, use barrier fluids to improve performance in blocking either ingress of environmental contaminants and components, or in blocking egress of contents or volatile constituents. While valved containers are widely used in industry, it is very rare for them to be seen in routine commerce of foodstuffs. In the instant case, low tolerance content exchange valves may be built into the closure 1200 and sealed with barrier sealant 1450.

In particular, the smooth pipe or tubing 1100 does not offer much resistance to slippage of the closure 1200 or closures 1200. Therefore, the assembly 1000 further comprises a longitudinal tension member 5100 provided within the cavity and adapted to arrest a motion of the closure 1200 with respect to the container 1100. In one embodiment, the longitudinal tension member 5100 is threaded. The use of the threaded longitudinal tension member 5100 to carry tension generated by gas pressure from the headspace 1140 or thermal expansion of the contents 1150 generally is not necessary, if the contents 1150 are packaged under vacuum, but recommended in cases where they are not. The longitudinal tension member 5100 may be disposed internally with the contents 1150, as in FIG. 5, or externally, which is not shown.

Removal of the closure 1200 described thus far relative to FIGS. 1 through 4 is necessary to facilitate access to the contents 1150. In general, it may be desirable to provide easier access to the contents 1150 of the container 1100 than complete removal of the closure 1200, as the operation of removing the closure 1200 requires removal of the barrier sealant 1450. To remove the contents 1150 and displace them with additional inert headspace 1140 gas, the one or more content exchange valves 5010 and 5020 can be connected to other vessels, one containing a supply of inert gas and one providing a container to receive the contents 1150. The valve 5010 is opened, then the valve 5020 is partially opened to allow gas to drive the contents 1150 into the receiving vessel. When a sufficient quantity of the contents 1150 have been dispensed, the the one or more content exchange valves 5010 and 5020 are closed. The residual material at the exits of the the one or more content exchange valves 5010 and 5020 may be cleaned off.

A variety of materials may be used as the barrier sealant, but the general properties sought are fluidity sufficient to allow filling of high aspect ratio spaces, low diffusivity, nontoxicity, low vapor pressure and most importantly, high barrier to diffusion. Preferably, the barrier sealant materials also would be inexpensive, although cost always can be balanced against performance. A large number of candidate materials meet these criteria. In general, these properties may be found in aqueous gels and solutions, which are well known in commerce for other purposes. Using a gel or thickened solution in place of pure water reduces the effect of convection, constraining transport of fugitive materials to diffusion, rather than allowing a combination of diffusion and convection to transport materials at a higher rate. If the gelling constituent or constituents further impede diffusion beyond simply stopping convection, by increasing viscosity and reducing diffusion coefficients, that is even more advantageous. Absolutely impermeable solids, such as clay nanoparticles, carbon materials, mineral fillers, quartz flour, fumed silica and many others may be added to the barrier fluid to alter viscosity and increase diffusion pathlength while further reducing diffusion.

Hydrocarbon, silicone and other greases and oils also may be used as the barrier sealant, in addition to aqueous and non-aqueous fluids. The use of silicone grease compositions as diffusion barriers is well known in the practice of vacuum technology, where the low vapor pressure and high aspect ratio are extremely useful. Silicone greases for high vacuum systems often are thickened with fumed silica, quartz flour, or other silica-based species that enhance diffusion barrier properties. The aspect ratios in the implementations described herein may be somewhat lower than are found in high vacuum systems, but the same general principles apply. Other additives, such as clay, mineral dust, metal flakes or carbon powder, also may be added to aqueous liquids, non-aqueous liquids, greases, gels, epoxy, acrylic, polyurethane or other liquids to significantly increase diffusion pathlengths, effectively increasing the aspect ratio of the barrier sealant. In some cases, the barrier sealant layer may be cured to a solid, semisolid or gel state by a variety of methods that are known in the art. For example, the fluid may be a UV-cure epoxy resin of the general type sold by several vendors, including, but not limited to Epoxy Technology, Henkel, or others. The barrier sealant may be injected into the sealing space under vacuum, then cured by time, heat, irradiation with electromagnetic energy or particles or the prior addition of a curing agent. The use of ultraviolet irradiation from light emitting diodes, xenon or mercury arc lamps is particularly convenient. Generally speaking, converting the fluid from a liquid to a gel or from a gel to a solid reduces the rate of diffusion, ceteris paribus.

Liquid metals, including low-melting solders, also are attractive diffusion barriers for certain applications. Sodium-potassium alloys, indium-gallium and indium-gallium-tin alloys can have melting points near and below room temperature. A variety of other low melting alloys including various combinations of indium, tin, and bismuth may be used to produce low-toxicity solder alloys suitable for use in the container and closure geometries described herein. The extremely high surface tensions of liquid metals tend to exclude oxygen and moisture from going into solution. If the metals can be injected at low temperatures and frozen in place, they can provide absolute sealing.

Example 1—Installation and Use

The sealing members 1310 and 1320 are installed on the closure 1200 by stretching them over the end and sliding them into the two grooves 1224 and 1226. Preferably, the sealing members 1310 and 1320 are lightly lubricated, as is well known in various trades. The contents 1150 are placed in the container 1100. In this example, the contents 1150 may be seeds that are sensitive to oxygen and moisture. An optional step is to place the container 1100 with the contents 1150 into a vacuum system and remove air, then backfill the headspace 1140 with inert gas. Any void space between the seeds also will be purged of air and replaced by inert gas by this operation. Alternatively, the closure 1200 may be inserted under vacuum, without inert gas backfill. In lieu of evacuating the headspace 1140, it simply may be purged with a suitable inert gas, which may be nitrogen or argon. Any desired oxygen absorbers, desiccants, environmental controls, indicators and condition sensors then are placed in the headspace 1140, which is located in the neck 1130 of the container 1100, below where the closure 1200 will be placed.

Optional absorbers 2100 may be attached to the closure 1200 by a hanger 2150 to a suitable hole pattern 2150 drilled in the bottom of the stopper 1200. The stopper 1200 is then inserted into the neck 1130 of container 1100 using a suitable actuator while maintaining vacuum or inert gas purge conditions. To maintain inert gas purge conditions, the assembly 1000 may be a handled in a glovebox with suitable atmosphere, where a vacuum purge cycle is provided by cycling the airlock to the glovebox. The vacuum may be relieved before or after the next step. The tip of a plastic syringe filled with the barrier sealant 1450 is inserted into the end of the one or more passages 1230 and 1240. The syringe then is operated to inject sealant into either of the one or more passages 1230 and 1240 until it completely fills the annular space 1400 and comes out of the other passage, respectively. The syringe typically would have a capacity in the range of 1 to 10 cc's, but the total volume of the annular space 1400 and the one or more passages 1230 and 1240 has been less than 0.4 cubic centimeters in many cases. Numerous containers 1100 typically can be sealed with a single syringe full of the barrier sealant 1450. One or more plugs 1510 and 1520 may be installed into the one or more respective sealant receiving ports 1232 and 1242 to prevent leakage of the barrier sealant 1450. An optional clamp 1610 may then be placed over the closure 1200 to prevent it from being dislodged by shipping, handling or gas pressure. Preferably, the clamp 1610 is secured by the tension member 1630, which may be a hose clamp, wire tie, or plastic zip tie that may engage the ring feature 1132. If the barrier sealant 1400 requires a curing cycle, possibly by ultraviolet light, radiation or heat exposure, it may be cured at this step in the process.

Example 2—Removal

At such time as the contents 1150 are to be used, the clamp 1610 is removed, for example, by cutting the ziptie 1630. Then the closure 1200 is pulled from the container 1100 and the contents 1150 dispensed by pouring or other appropriate method. To facilitate pulling, the rim 2010 of the closure 1200 may be knurled or drilled, or provided with other well-known extraction features. After the closure 1200 is pulled, the barrier sealant 1450 may be wiped from the closure 1200 and rim of the container 1100. Very little of the barrier sealant 1450 will be left in or on the neck 1130, because the bottom sealing member 1320 acts as a wiper to pull the barrier sealant 1450 out of the neck 1130 and onto the rim of the container 1100, where it can be easily wiped off or rinsed away. The contents 1150 of the container 1100 then may be dispensed. After the container 1100 is empty, both it and the closure 1200 may be thoroughly cleaned, for example by a dishwashing machine, to remove residues of the contents 1150 and the barrier sealant 1450. The container 1100, the closure 1200 and clamp 1610 then are ready for reuse as described above.

Example 3—Installation and Use

Install the two sealing members 1310 and 1320 on the closure 1200 by stretching and sliding into place in the two grooves 1224 and 1226. Preferably, the two sealing members 1310 and 1320 are lightly lubricated with a food-grade oil or grease to facilitate installation and sealing. Place the contents 1150 in the container 1100. In this example, the contents 1150 may be oxygen and moisture sensitive nuts, such as walnuts. Place the container 1100 with the contents 1150 into vacuum system and remove air in headspace 1140 and the second cavity 2040. Attach absorbers 2100 such as desiccant and oxygen absorber to the closure 1200, so that they will hang in the headspace 1140. Place the environmental controls in the second cavity 2040. Insert the closure 1200 into neck 1130 of the container 1100 using suitable actuator while maintaining vacuum conditions or inert gas atmosphere as before.

The vacuum may be relieved before or after the next step. Insert the tip of a plastic syringe filled with the barrier sealant 1450 into one of the one or more sealant receiving ports 1232 or 1242 in the closure 1200 and inject until the barrier sealant comes out of the other sealant receiving port 1232 or 1242, as the case may be. If the system still is under vacuum and there is only one passage 1230, with the second passage 1240 being optional, then the syringe may be injected into the passage 1230 to completely fill the annular space 1400 with the barrier sealant 1450. If the annular space 1400 is well evacuated, there will be no gas present to impede complete filling of the passage 1230 and the annular space 1400. The syringe typically should have a capacity in the range of 1 to 10 cc's. For a large opening container 1100 with a nominal neck finish diameter around 3", the annular space may have a volume in the range of 1 to 10 cc's, depending on how tight the fit is between the neck 1130 and the closure 1200.

The one or more plugs 1510 and 1520 may be installed into the one or more respective sealant receiving ports 1232 and 1242. Place the clamp 1610 or the second closure 2030 over the closure 1200 to prevent the closure 1200 from being dislodged by shipping and handling. The flat glass plate 3050 with the plastisol sealing gasket 2034 may be installed under the second closure 2030 to close off the second cavity 2040 from the environment. A number of alternatives for the clamp 1610 are available to insure that the closure 1200 does not slip out of the neck 1130, e.g., as a result of environmental heat expanding the contents 1150 and any gas in the headspaces 1140 and the second cavity 2040. A foil wrapper of the type used in the wine industry, or a heat shrink tubing also may be used to secure the closure 1200 in the neck 1130 of the container 1100 as described relative to FIG. 1. Such devices are well understood in the packaging trade.

Example 4—Installation and Use

The container 1100 in form of tubing or pipe should be thoroughly cleaned after machining to remove potential contaminants, as well as all of the other components, particularly including the closure 1200, the one or more content exchange passages 3510 and 3520 and the longitudinal tension member 5100. The closure 1200 is inserted into the container 1100 and the content exchange valve 5010 closed. The contents 1150 could be poured into the container 1100 up to a level that leaves sufficient space for the closure 1200 at a second open end of the container 1100, or the system could be closed with the closure 1200 at the second open end before filling via the one or more content exchange valves 5010 and 5020 and the one or more content exchange passages 3510 and 3520. Typically, the longitudinal tension member 5100 would be permanently installed into the closure 1200.

The permanent attachment of the longitudinal tension member 5100 to the closure 1200 simplifies the cleaning process for reuse, because the contents 1150 cannot seep into the threads at the point of contact between the longitudinal tension member 5100 and the closure 1200. With the contents 1150 in place, the closure 1200 at the second end can be slid into the bore of the container 1100 until it contacts the longitudinal tension member 5100. At this point, the closure 1200 at the second end must be gently turned relative to the assembly of the container 1100, the closure 1200 at the first end and the longitudinal tension member 5100, until the lip portion 2010 meets the rim of the container 1100. Now, the barrier sealant 1450 may be introduced into one of the one or more passages 1230 and 1240 using a syringe, until it fills the annular space 1400 and the auxiliary annular space 3200. The plugs 1510 and 1520 then are installed in the passages 1230 and 1240 at both of the first end and the second end to block escape of the barrier fluid sealant 1450. The filled container 1100 is now ready for use in storage or shipping. The contents 1150 may be dispensed by opening the one or more content exchange valves 5010 and 5020, and applying a small amount of inert gas pressure.

The terms and descriptions used herein are set forth by way of illustration only and are not meant as limitations. Examples and limitations disclosed herein are intended to be not limiting in any manner, and modifications may be made without departing from the spirit of the present disclosure. Those skilled in the art will recognize that many variations are possible within the spirit and scope of the disclosure, and their equivalents, in which all terms are to be understood in their broadest possible sense unless otherwise indicated.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be providing broadest scope of application consistent with the principles and the novel and inventive features disclosed or suggested herein. Accordingly, the disclosure is anticipated to hold on to all other such alternatives, modifications, and variations that fall within the scope of the present disclosure and appended claims.

The invention claimed is:

1. An assembly of a closure with a container, for sealing of the container, the assembly comprising:

a container having an inner container surface defining a cavity opening to ambient through an opening;

a closure comprising:

an upper portion and a lower portion, wherein the lower portion comprises a lower lateral surface, the lower portion being adapted to be inserted into the opening of the container; and two grooves provided on the lower lateral surface and adapted to receive two respective sealing members, the two grooves being separated by a predetermined distance;

the two sealing members provided in the two respective grooves, the two sealing members being adapted to provide sealing between the lower lateral surface and the inner container surface, wherein the lower lateral surface, the inner container surface and the two auxiliary sealing members together define an annular space;

a barrier sealant in the annular space; and a longitudinal tension member provided within the cavity and adapted to arrest motion of the closure with respect to the container.

2. The assembly as claimed in claim 1, further comprising a clamping arrangement adapted to clamp the closure with the container.

3. The assembly as claimed in claim 1, wherein the closure further comprises one or more passages connecting one or more respective sealant receiving ports in the upper portion with one or more respective lateral openings, between the two grooves, in the lower lateral surface.

4. The assembly as claimed in claim 1, further comprising one or more plugs provided at the one or more respective sealant receiving ports, the one or more plugs being adapted to prevent the barrier sealant from escaping through the one or more respective passages.

5. The assembly as claimed in claim 1, wherein the closure is made up of material selected from a group consisting of metals, ceramics, glasses and polymers.

6. The assembly as claimed in claim 1, wherein the upper portion further comprises a second cavity.

7. The assembly as claimed in claim 6, wherein the second cavity is adapted to receive one or more environmental indicators and an environmental control element.

8. The assembly as claimed in claim 1, further comprising a second closure having a substantially flat disk fastened to the container and placed above the closure.

9. The assembly as claimed in claim 8, further comprising a flat glass plate placed between the substantially flat disk and the closure.

10. The assembly as claimed in claim 9, wherein the upper portion further comprises two auxiliary grooves provided at an upper surface of the upper portion, the two auxiliary grooves being adapted to receive two respective auxiliary sealing members, wherein the two auxiliary grooves are oriented in a direction normal to the two grooves.

11. The assembly as claimed in claim 10, wherein the one or more passages further connect the one or more respective sealant receiving ports in the upper portion with one or more respective upper openings, between the two auxiliary grooves, in the upper surface.

12. The assembly as claimed in claim 11, further comprising the two auxiliary sealing members adapted to provide sealing between a lower plate surface of the flat glass plate and the upper surface, wherein the upper surface, the lower plate surface and the two auxiliary sealing members define an auxiliary annular space.

13. The assembly as claimed in claim 1, wherein the closure further comprises one or more content exchange passages connecting the cavity to one or more respective content exchange ports in the upper portion, the one or more content exchange passages being adapted to receive and deliver content in and out of the cavity, respectively.

14. The assembly as claimed in claim 13, further comprising one or more content exchange valves provided at the one or more respective content exchange ports and adapted to open and close the one or more respective content exchange passages to the atmosphere.

15. The assembly as claimed in claim 1, further comprising a longitudinal tension member provided within the cavity and adapted to arrest a motion of the closure with respect to the container.

16. The assembly as claimed in claim 1, wherein the barrier sealant is selected from a group consisting of an aqueous solution, a non-aqueous solution, grease, epoxy, acrylic, polysulfide, UV-cure, time-cure, polyurethane and adhesive.

17. The assembly as claimed in claim 1, wherein the upper portion further comprises a lip portion, a width of the lip portion being greater than a width of the opening of the container.

* * * * *